US008113355B1

(12) United States Patent
Peterson

(10) Patent No.: US 8,113,355 B1
(45) Date of Patent: Feb. 14, 2012

(54) CLASSIFYING KITS

(76) Inventor: Mark Peterson, Eugene, OR (US)

( * ) Notice: Subject to any disclaimer, the term of this patent is extended or adjusted under 35 U.S.C. 154(b) by 0 days.

(21) Appl. No.: 13/100,191

(22) Filed: May 3, 2011

(51) Int. Cl.
*B07B 1/00* (2006.01)

(52) U.S. Cl. ..... 209/235; 209/44; 209/315; 241/24.1; 241/24.15; 241/24.25

(58) Field of Classification Search ..... 209/44, 209/235, 315; 241/24.1, 24.15, 24.25
See application file for complete search history.

(56) References Cited

U.S. PATENT DOCUMENTS 1,030,673 A * 6/1912 McIlvaine ..... 209/405
1,350,080 A * 8/1920 Notter ..... 209/348
1,444,275 A * 2/1923 Robertson ..... 209/405
1,563,193 A * 11/1925 Ingleton ..... 209/370
2,252,701 A * 8/1941 Copeman ..... 209/255
3,367,497 A * 2/1968 Loock et al. ..... 209/312
4,472,269 A * 9/1984 Swick ..... 209/44
5,190,158 A * 3/1993 Remias ..... 209/44
5,423,430 A * 6/1995 Zaffiro et al. ..... 209/315

* cited by examiner

*Primary Examiner* — Terrell Matthews
(74) *Attorney, Agent, or Firm* — Baumgartner Patent Law; Marc Baumgartner

(57) ABSTRACT

Classifying kits useful in separating gold, other precious metals, gems, collectable rocks, fossils, and archaeological artifacts from earth material. Classifying sieves and other parts of the classifying kits herein are configured to be used within a bucket and can readily be removable therefrom. Depending on the parts used and the goals of a user, the kits herein can be used with dry sifting methods or with water.

17 Claims, 8 Drawing Sheets

CLASSIFYING KITS

FIELD OF THE INVENTION

The embodiments herein relate to classifying kits useful in separating gold and other precious metals, gems, collectable rocks, fossils, and archaeological artifacts from earth material using either wet or dry filtering methods.

BACKGROUND

The use of stackable classifying sieves for separating objects such as fossils, artifacts, gold, gems, and rocks from earth material based on size has been attempted. As one example, the Hubbard #548 Screen Six Sieve Set available from Forestry Suppliers, Inc., is a kit having multiple sieves, each with different mesh sizes, stacked upon each other such that the largest mesh size is on top and the sieve with the finest mesh size is on the bottom. Unfortunately, this particular configuration has multiple disadvantages.

As one example, the system with its multiple exposed parts is not easy to transport as one unit, and is likewise not easily shaken to separate objects from earth material. Additionally this system is not configured for allowing sluicing, such as when a user wishes to further separate small objects from water based on weight. The system does not appear to allow for wet separation of materials either, as there does not appear to be a water exit hole at the bottom of the system.

Accordingly, there is a need in the art, and an objective of the teachings herein to overcome the disadvantageous of current products used for separating objects from earth material

SUMMARY OF THE INVENTION

Preferred embodiments are directed to kits for classifying objects from earth material comprising: a bucket having a top aperture opening to a lower main cavity defined by a periphery, and a bottom surface; a first classifying sieve having a mesh screen surrounded by a perimeter and configured to be removably positioned inside the main cavity near the top aperture of the bucket; and a support sleeve configured to removably fit within the bucket near the bucket periphery such that it is vertically supported by the bottom surface of the bucket and includes a top surface that provides vertical support for the first classifying sieve. Said embodiments are further directed to the use of multiple classifying sieves, a funnel, a sluice, and a base bowl.

Further embodiments are directed to kits for classifying objects from earth material comprising: a substantially cylindrical bucket having a top aperture opening to a lower main cavity defined by a periphery that slightly tapers downward to a bottom surface; a first classifying sieve, having a substantially cylindrical shape, and having a mesh screen surrounded by a perimeter and having means to be removably positioned inside the main cavity of the bucket. Said embodiments are further directed to the use of multiple classifying sieves, a funnel, a sluice, and a base bowl.

BRIEF DESCRIPTION OF THE DRAWINGS

It will be appreciated that the drawings are not necessarily to scale, with emphasis instead being placed on illustrating the various aspects and features of embodiments of the invention, in which.

DETAILED DESCRIPTION OF THE ILLUSTRATED EMBODIMENTS

Embodiments of the present invention are described below. It is, however, expressly noted that the present invention is not limited to these embodiments, but rather the intention is that modifications that are apparent to the person skilled in the art and equivalents thereof are also included.

Figure 1:
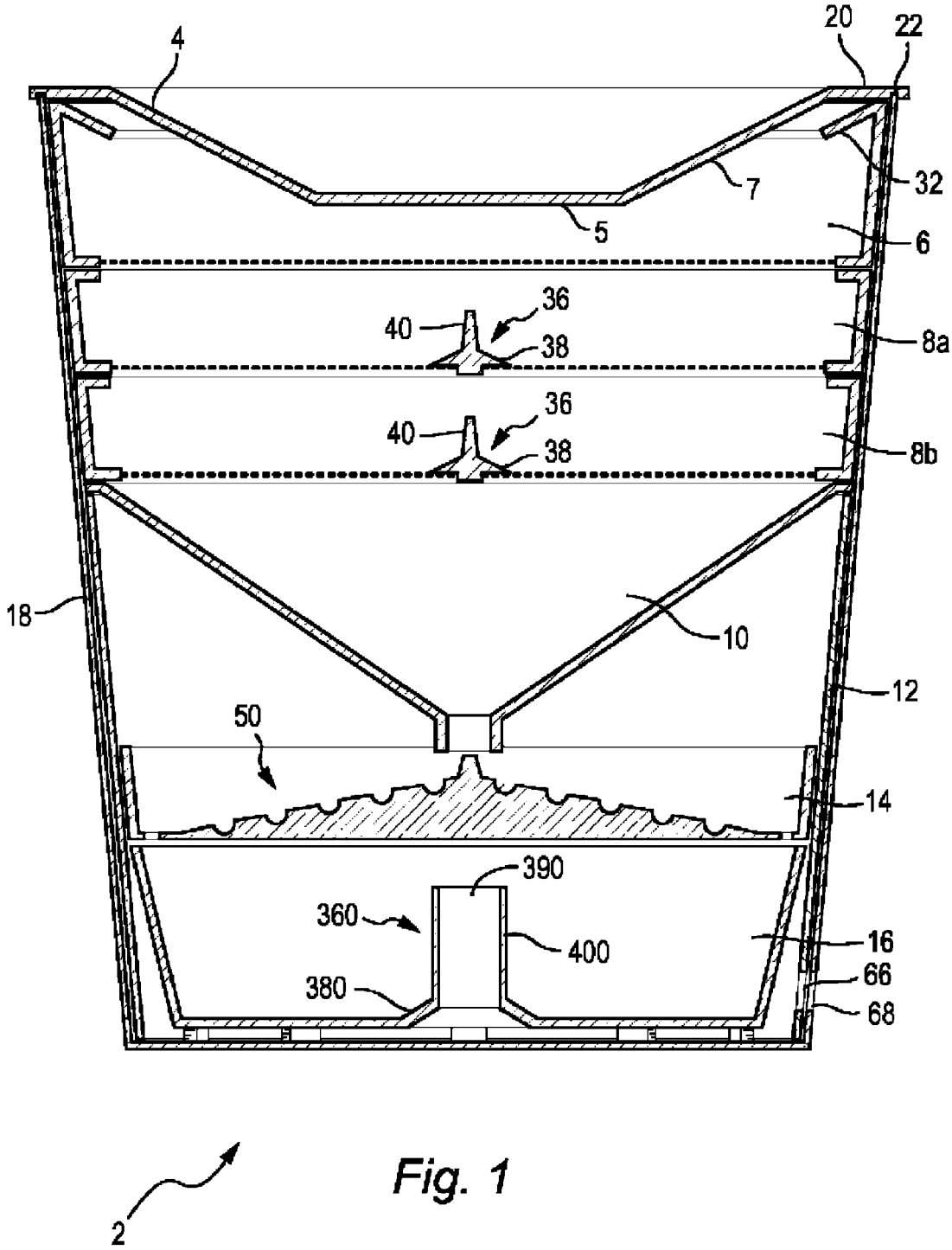
FIG. 1 is a cross sectional view of a preferred sifting assembly.

FIG. 1 shows a cross-sectional view of a preferred kit 2 described herein. According to the teachings herein, the parts of the kit are configured to be removably held and used within a bucket 18. Parts of the kits 2 herein can include the following: a lid 4, a top sieve 6, a first lower sieve 8*a*, a second lower sieve 8*b*, a funnel 10, a sleeve 12, a sluice section 14, and a bowl 16. Depending on the parts used in, and the desires of a user, the kits 2 herein can be used for separating objects such as gold, rocks, gems, fossils, and artifacts from earth material using water or through dry sifting methods.

In general the earth material, such as mud, dirt, clay, or any other granular material which can be broken apart by a sieve, is placed into the top sieve 6 which has the largest mesh sized screen of the sieves used in the kits herein. The earth material can then be filtered using water or dry methods through the top sieve 6 and the lower sieves 8*a* and 8*b* each having progressively finer mesh screens, such that the lowest sieve 8*b* has the finest mesh screen of all sieves in the kit 2. According to preferred embodiments, the lowest sieve 8*b* can be vertically supported by a funnel 10 FIG. 1. In general, the use of a funnel 10 is not required for dry sifting, but can be advantageous for wet sifting, where water is poured into the top of the bucket through the classifying sieves 6, 8*a*, and 8*b*. The funnel 10 can vertically be supported by a sleeve 12. The funnel 10 can be positioned above and configured to allow fluid communication with a lower sluice section 14 that includes a radial sluice 50 surrounded by a periphery 54. In turn, the sluice section 14 can be vertically supported by and configured to allow for fluid communication with a lower base bowl 16.

While any suitable bucket 18 can be used with the teachings herein, it is preferred that the bucket 18 has slightly downward tapering sides to allow it to be stackable with other like shaped buckets 18. Downwardly tapering sides also allows for the different parts of the kit 2 to be internally stacked based on diameter size, such that the diameter of the various parts decreases from largest to smallest as they are positioned from the top to the bottom of the bucket 18. According to further embodiments, it is preferred that the bucket 18 is a standard five gallon plastic bucket, readily available from multiple stores. Thus one advantage of the teachings herein is that they can utilize a very inexpensive, durable, and widely available bucket to not only use for separating materials but also for easily carrying all of the parts of the kit 2. More specifically, in addition to the parts shown in FIG. 1, the buckets 18 described herein can also include further objects, such as manuals, guides, hand scoops, tweezes, and collection vials, useful in classifying objects from earth material. Preferred buckets herein include a swiveling metal handle for easier carrying, such as those include in commercially available 5 gallon buckets.

While a bucket 18 is used for the teachings herein, the kits 2 can be sold with or without the bucket 18. When sold without a bucket 18 it is preferred that the kits 2 include instructions for a user to simply acquire a bucket 18 on their own. According to highly advantageous embodiments, the only modification that a user may want to perform on a store bought bucket 18 is to add a drainage hole 68 in the bottom section, such as using a drill. Non-exclusive examples of drainage hole 68 diameters can be between 1.5-3 inches, such as 2 inches, for example. While preferred embodiments are directed to buckets having cylindrical cross-sections as shown in FIG. 1, other shaped buckets such as those have a square or rectangular cross-sections can also be expressly used with the teachings herein, according to non-preferred embodiments. The parts described herein can be shaped accordingly to conform to the bucket shape. For example, if the bucket utilizes a square cross-section, the parts herein can include square cross-sections as well.

Figure 3:
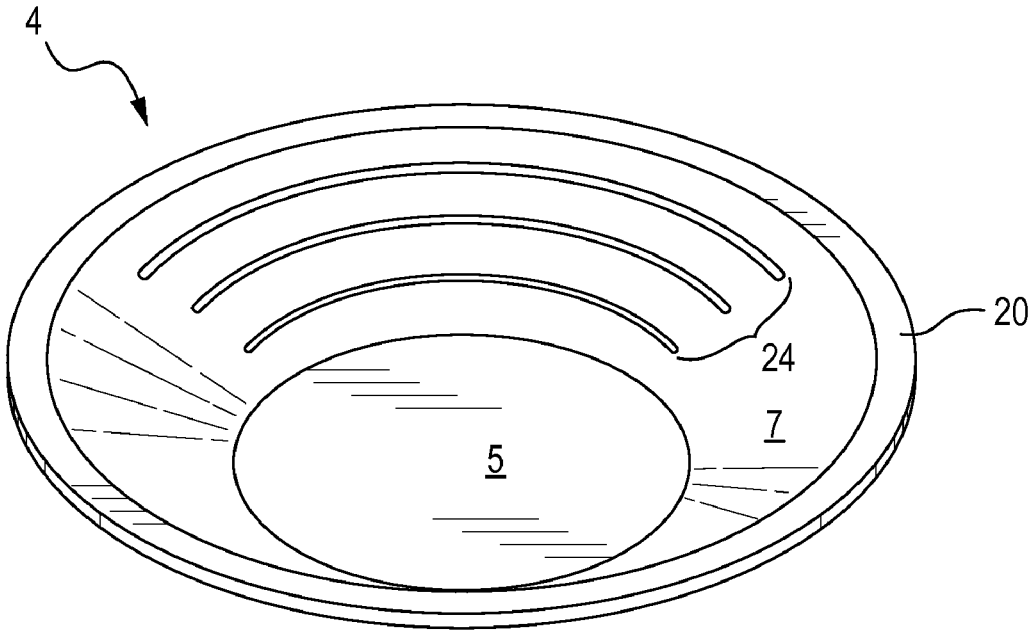
FIG. 3 is a perspective view of the topside of a lid.
Figure 4:
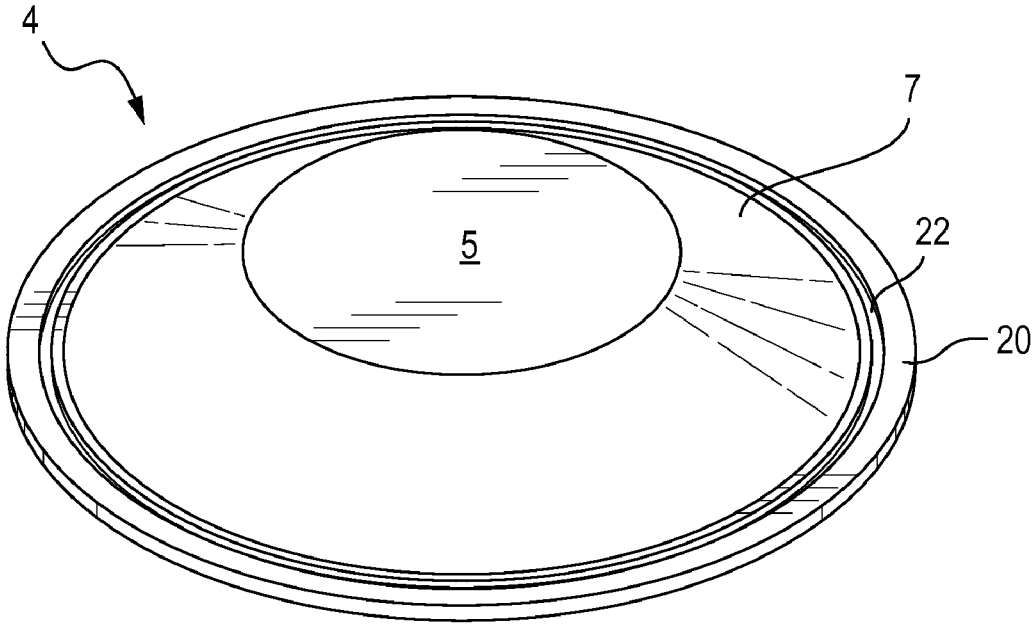
FIG. 4 is a perspective view of the underside of a lid.

Preferred kits 2 include a dual functioning lid 4 that can be configured such that it can close the bucket 18 to prevent the parts from falling out and also be used as a gold pan. For this particular embodiment, and as shown in FIGS. 3 and 4, it is preferred that the lid 4 is in the general shape of a standard gold pan having sides 7 that taper downward to a flat recessed bottom 5. According to preferred embodiments, the lid 4 can have a conical cross-section, although other general gold pan shapes can also be used. The inner sides of the lid 4 can include common features in gold pans such as one or more protrusions or riffles 24 to assist in separating materials from each other. Preferably the lid 4 includes an outwardly projecting peripheral lip 20 at its top having an underside circumferential groove 22 for snapping onto the top rim of the bucket 18 to create a releasably secure fit. When the lid 4 is secured to the top rim of the bucket 18, the bottom 5 and sides 7 of the lid 4 project downward into the internal space within the bucket. The lid 4 can be made of any suitable material such as high impact plastic or metal, such as steel. According to non-preferred embodiments, no lid, or a non gold pan lid can be used with the kits herein.

Figure 5:
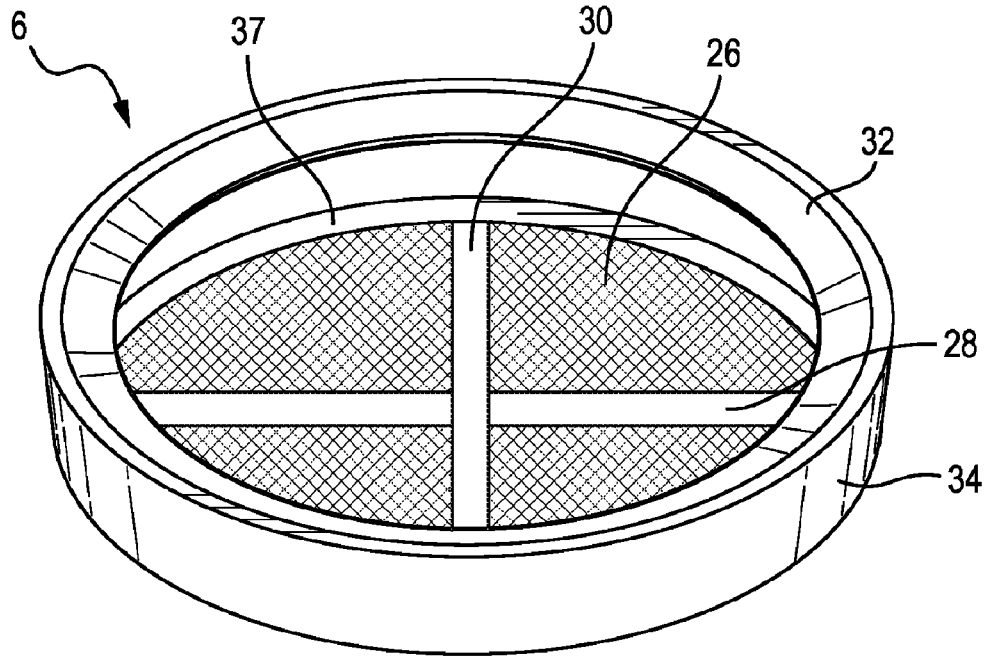
FIG. 5 is a perspective view of the topside of an upper sieve.

According to a first embodiment, the assemblies 2 herein include at least a top classifying sieve 6 configured to be positioned near the top of the inside of the bucket 18. FIG. 5 shows a perspective view of a type of top classifying sieve 6. In general, the top sieve 6 includes a periphery 34 that traverses upwards from an inwardly extending lower rim 37 surrounding a mesh screen 26 that forms the bottom surface. According to more preferred embodiments, the periphery 34 functions as a wall to help keep the filtered material from falling off the screen 26. The upwardly projecting periphery 34 is preferably made of high impact plastic, but can be made of any suitable material, such as metal or steel. Preferably the periphery 34 of the top sieve 6 is in very close proximity to but does not touch the inner walls of the bucket 18 in its natural resting position, such as when the bucket 18 is not being shaken. As an example, the periphery 34 can be about ⅛ of an inch from the bucket 18 walls. For embodiments where a user shakes the bucket 18, the periphery 34 would come into contact with the inner walls of the bucket 18.

The actual mesh screen 26 can be made of any suitable material such as high impact plastic or metal wire, such as steel. The bottom of the top sieve 6 preferably includes first and second support bars 28 and 30 that intersect to define 4 quadrants in the screen 26. The sectioning into quadrants helps in the visual inspection of the material when looking for nuggets and gems and also provides strength to the overall screen 26. The support bars 28 and 30 can be integrated with the screen 26 such that they define one surface along with the lower rim 37, or substantially so. Alternatively the screen 26 can be vertically supported by support bars 28 and 30 and the lower rim 37 and positioned on top of them, preferably flat, or substantially so. Other embodiments include an uninterrupted mesh within the periphery without the support bars 28 and 30.

Advantageously, the top classifying sieve 6 includes means for allowing for its removal from the bucket 18. According to certain embodiments, wherein the concave bottom of the lid 4 extends downward into the top section of the bucket 18 when secured, the use of an upwardly extending protrusion 36, such as used on lower sieves 8*a* and 8*b* discussed below, can be disadvantageous as it could prevent the lid 4 from being secured to the bucket 18 if it is extends upwardly too high. Thus it can be advantageous to utilize an upper rim 32 downwardly, and inwardly angled from the top of the periphery 34. According to further embodiments the upper rim 32 is angled such that it is does not interfere with the securing of the lid 4 to the bucket 18. According to more specific embodiments, the upper rim 32 can be angled at the same, or substantially the same angle as the downwardly tapering sides of the lid 4, such that they are parallel or substantially so. The upper rim 32 is highly advantageous in acting as means for allowing removal of the top sieve 6 from the bucket 18 and also for functioning as a splash guard. More specifically, when a user pours water into the bucket 18 to separate solid particles from the earth matter in the top sieve 6, the upper rim 32 can alleviate water and materials from splashing out of the bucket 18.

While shown as a continuous rim 32 in FIG. 5, it is expressly contemplated that the upper rim 32 can be segmented, or only be one or more downwardly projected handles. According to other embodiments, the top sieve 6 can include an upwardly extending protrusion positioned in the middle of the screen 26 that is short enough not to interfere with the bottom 5 of the lid 4, thereby allowing for secure attachment of the lid 4 to the bucket 18. Suitable protrusions are discussed below in detail with relation to the lower classifying sieves 8*a* and 8*b*. Furthermore it is advantageous to have the top sieve 6 have a deeper body than the lower sieves 8*a* and 8*b* to allow for a suitably high protrusion and/or to alleviate backsplash for wet filtering methods. As an example, the top sieve 6 can be approximately 1.5, 2, 2.5, or 3 times as deep as the first lower sieve 8*a*, or deeper.

Figure 2:
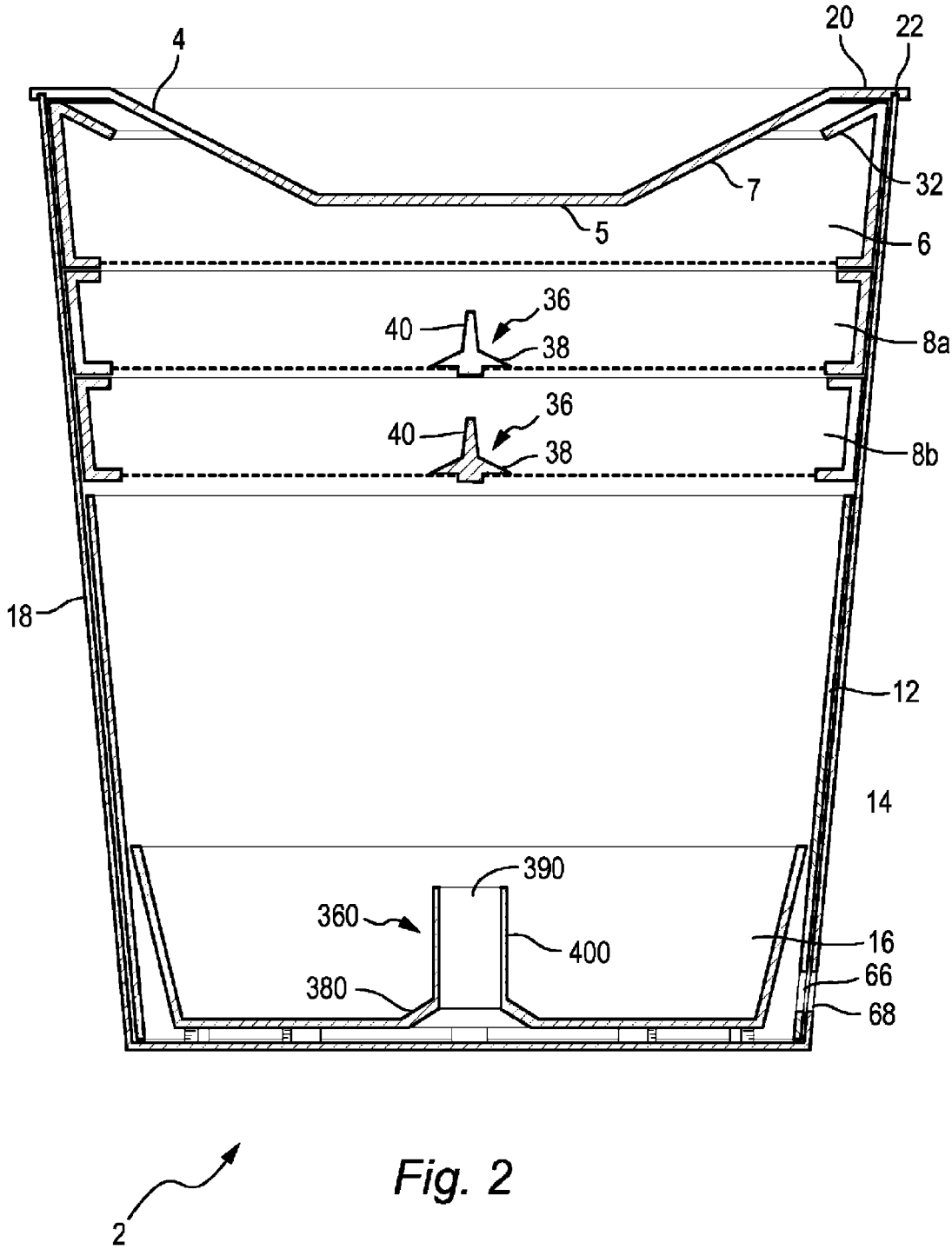
FIG. 2 is a cross sectional view of an alternative sifting assembly.

Preferably the top sieve 6 is stacked on top and vertically supported by one or more lower sieves 8*a* and 8*b*. FIGS. 1 and 2 depict the use of two lower sieves 8*a* and 8*b*, but the teachings herein expressly contemplate the use of more than two lower sieves, such as three, four, five, and six or more sieves, depending on the size of the bucket 18, and whether a funnel 10 and/or sluice section 14 is positioned below. As will be discussed below, the lowest sieve 8*b* is preferably vertically supported by a sleeve 12 that rises upwards from the bottom of the bucket 18. According to embodiments where only one sieve, such as a top sieve 6 is used, the sleeve 12 can vertically support the single sieve 6.

According to non-preferred embodiments, instead of being directly stacked on top of each other and the sleeve 12, other means can be provided for vertically supporting the sieves. Non-exclusive examples include internal ridges or grooves within the bucket. This particular configuration is not preferred as the walls of the bucket would have to be significantly tapered to allow for lower sieves to be removed past upper support ridges or to install lower sieves below higher grooves. Additionally, as standard buckets do not currently have these support ridges, the buckets would have to either be custom made or modified, which complicates the teachings herein.

As mentioned above, the sieves 6, 8*a*, and 8*b* advantageously can be positioned vertically based on mesh size and diameter, such that the mesh size and diameter decreases from the top of the bucket to the bottom. Thus the top sieve 6 would have larger openings in its mesh screen 26 than the first lower sieve 8*a* which in turn would have larger openings in its mesh screen than the second lower sieve 8*b*. As a non-exclusive example, and with respect to U.S. mesh sizing, the top sieve 6 can be 10 mesh, the first lower sieve 8*a* can be 60 mesh, and the second lower sieve 8*b* can be 120 mesh. If more than two lower sieves are used, the additional sieves can have progressively finer screens than the second lower sieve 8*b*. It is preferred that the lowest sieve 8*b* has a mesh size that is fine enough that the solid materials passing through will not clog the stem 46 of the funnel 10 such as to hinder or prevent water flow. According to certain embodiments, such as when a user is not utilizing a funnel 10 and sluice section 14, the lowest sieve 8*b* can be vertically supported by an internal sleeve 12, as shown in FIG. 2.

Figure 6:
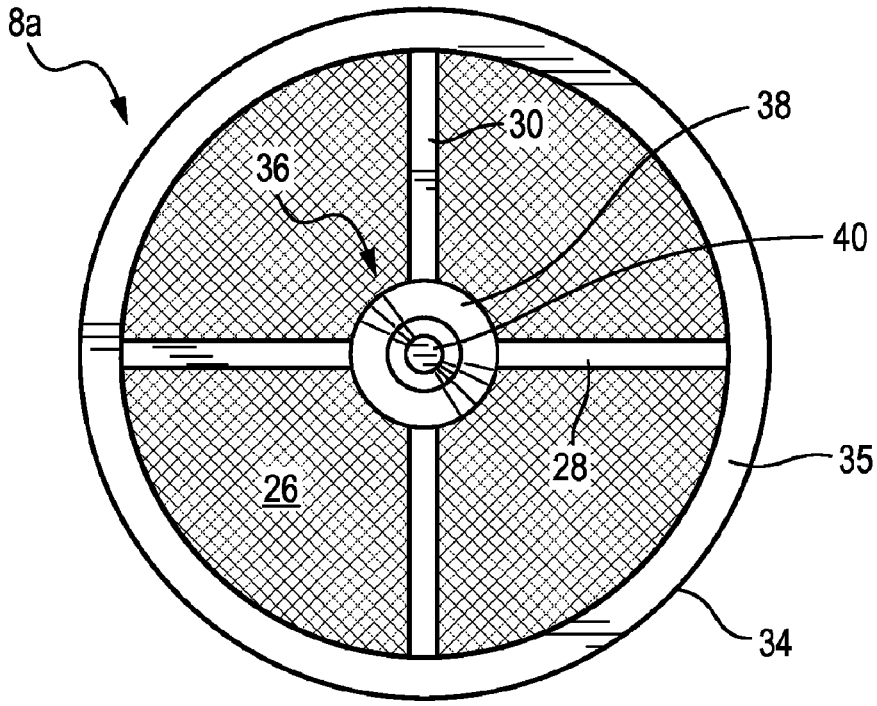
FIG. 6 is a top view of a lower sieve.
Figure 7:
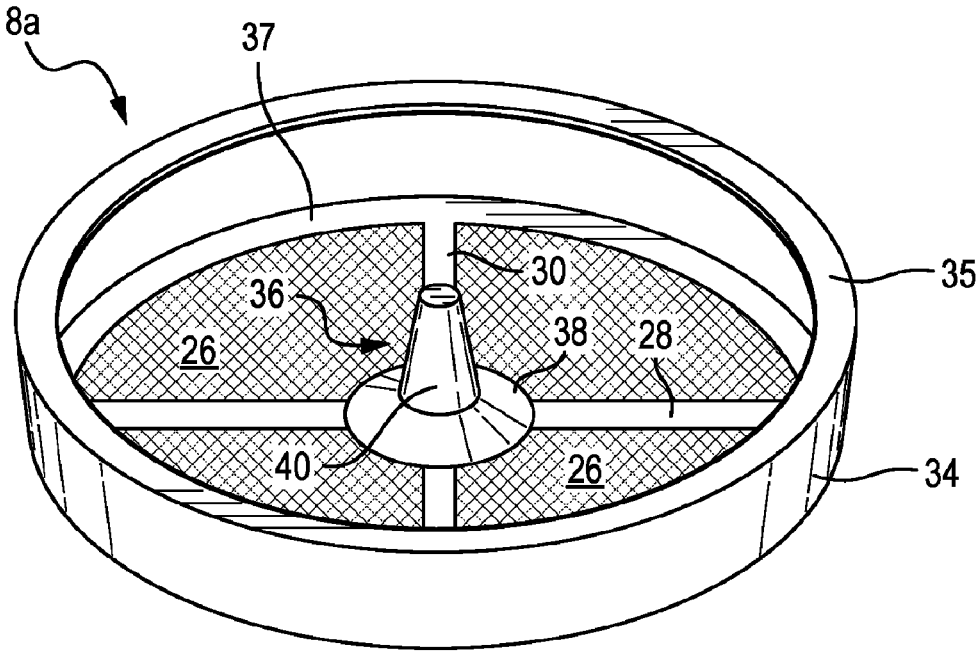
FIG. 7 is a perspective view of the topside of a lower sieve.

FIGS. 6 and 7 show an advantageous lower sieve 8*a*. The second lower sieve 8*b* and potentially other lower sieves can be the same as the first lower sieve 8*a*, but have slightly smaller diameters, and smaller openings in their mesh screen 26, as mentioned above. Similar to the top sieve 6, the lower sieve 8*a* includes a periphery 34 that traverses upwards from an inwardly extending lower rim 37 surrounding a mesh screen 26 that forms the bottom surface. According to more preferred embodiments, the periphery 34 functions as a wall to help keep the filtered material from falling off the screen 26. The upwardly projecting periphery 34 is preferably made of high impact plastic, but can be made of any suitable material, including metal, such as stainless steel. Preferably the periphery of the lower sieve 8*a* is in very close proximity to but does not abut against inner walls of the bucket 18 in its natural resting position, such as when the bucket 18 is not being shaken. As an example, the periphery 34 can be about ⅛ of an inch from the bucket 18 walls. For embodiments where a user shakes the bucket 18, the periphery 34 would come into contact with the inner walls of the bucket 18. According to preferred embodiments, even when the upper sieve 6 and/or the lower sieves 8*a* and 8*b* move slightly in horizontal directions, the vertical abutment between them is not broken.

The actual mesh screen 26 can be made of any suitable material such as high impact plastic or metal wire, such as steel. The bottom of the lower sieve 8*a* preferably includes first and second support bars 28 and 30 that intersect to define 4 quadrants in the screen 26. The sectioning into quadrants helps in the visual inspection of the material when looking for nuggets and gems and also provides strength to the overall screen 26. Preferably a protrusion 36 extends upwards from bottom of the sieve 8*a* to function as a handle for a user to grip when desiring to remove or position the lower sieve 8*a*. More specifically it is preferred that the protrusion 36 is positioned centrally on the bottom of the sieve 8*a* such as at the intersection of the support bars 28 and 30.

Although any suitable vertical extension can be used, one advantageous design includes a vertical stem 40 that extends upwards from a base skirt 38 that flanges outward at a downward angle. The flanged skirt 38 is advantageous as it is configured to direct materials to descend towards the screens 26 for sieving. It can also be advantageous to have the edges of the skirt 38 form right angles or substantially so with the support bars 28 and 30 to allow the screen 26 to be substantially planar with the support bars 28 and 30. The protrusion 36 should not extend too high such as to interfere with the underside of the sieve positioned directly above it. Alternatively, according to non-preferred embodiments, the lower sieve 8*a* can include an upper rim, inwardly and downwardly angled from the top of the periphery 34, such as shown in FIG. 5.

According to certain manufacturing embodiments applicable to all sieves 6, 8*a*, and 8*b*, a screen 26, can be supported on top of the support bars 28 and 30 and the lower rim 37, or made to be integral with these parts, preferably such that they are level, or substantially so. For example, the entire sieve 6, 8*a*, and 8*b* can be made from a single plastic mold. For certain embodiments where the sieve 6, 8*a*, and 8*b* includes a vertical protrusion 36, a separate screen having a central hole sized to fit over the vertical protrusion 36 can be pressed down onto the support bars 28 and 30 and the lower rim 37 such that the screen 26 is vertically supported by and level with the support bars 28 and 30 and the lower rim 37. The screen 26 can be held in place using any suitable means, including welding, adhesives and fasteners. As one example, a ring, such as rubber ring can be positioned on top of the periphery of the screen 26 and glued, or otherwise fastened to the inner periphery 34 and/or lower lip 37 of the sieve. The ring can include any suitable cross-section such as entirely square, rectangular, or circular, but according to preferred embodiments, the cross-section can have a quarter-round shape. According to more specific embodiments, the central hole in the screen 26 is configured to fit closely around the base of the skirt 38. It can also be advantageous to have the edges of the skirt 38 form right angles or substantially so with the support bars 28 and 30 to readily allow the screen 26 to be substantially planar with the support bars 28 and 30 and lower rim 37. Other embodiments include an uninterrupted mesh within the periphery lacking support bars 28 and 30 and/or a vertical protrusion 36.

Figure 11:
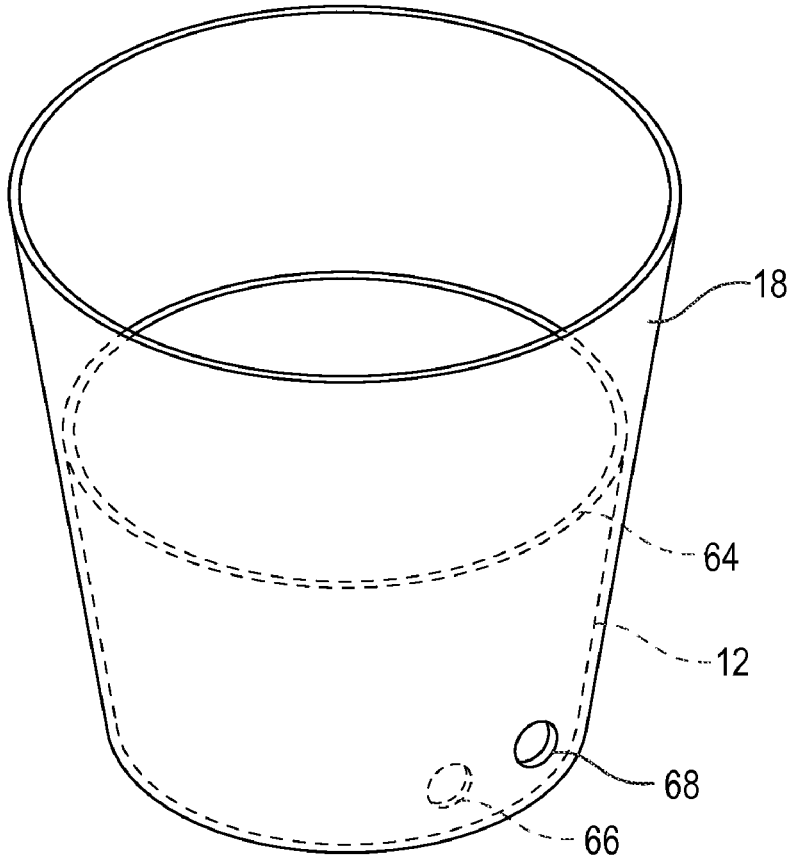
FIG. 11 shows a side view of a sleeve within a bucket.

As shown in FIG. 11, it is preferred to have a sleeve 12 positioned at the bottom of the bucket 18, and having sides that extend upwards alongside the bucket 18 walls to the underside of the lowest sieve 8*b* to provide a vertical support structure for the sieves 6, 8*a* and 8*b*. More specifically, the upper edge 64 of the sleeve 12 can abut against the underside perimeter of the lowest sieve 8*b*. The sleeve 12 preferably is configured such that its outer face fits tightly with the inner walls of the bucket 18, and is of a thickness sufficient to provide vertical support to the underside of the lowest sieve 8*b* and higher sieves 8*a* and 6 above.

Advantageously, the sleeve 12 includes a hole 66, that is preferably the same or substantially the same size as the hole 68 in the lower half of the bucket 18. As an example, the hole 66 can be between 1.5 to 3 inches, including 2 inches in diameter. Preferably the kits 2 herein include means for both preventing and allowing liquid and matter from escaping from the sleeve's hole 66 though the bucket's hole 68. According to one embodiment, the sleeve 12 can be configured to spin around within the bucket thereby allowing the hole 66 in the sleeve 12 and the hole 68 in the bucket 18 to either align or not align. FIGS. 1 and 2 show the holes 66 and 68 aligned thereby allowing water and other filtered matter to flow out of the bucket 18, while FIG. 11 shows the holes 66 and 68 unaligned thereby preventing or discouraging water and matter flow exiting the bucket 18. Alternative ways of allowing and preventing or discouraging water flow from the sleeve 12 and bucket 18 include a spigot, valve, or removable plug or stopper, as non-exclusive examples. An unaligned or closed configuration can be advantageous for capturing dry material, while an open configuration can be advantageous for wet sifting to allow water to exit the bucket 18. Additionally, the bucket and sleeve can each include 2 or more similarly sized holes that can each be aligned/unaligned or opened and closed. The sleeve 12 can be made of any suitable material, but is preferably made of high impact plastic. The sleeve 12 can be entirely cylindrical, or substantially so, without a bottom panel, or alternatively according to non-preferred embodiments can include a bottom panel. While shown as a continuous piece, the sleeve can alternatively be two or more pieces that are unconnected.

Figure 12:
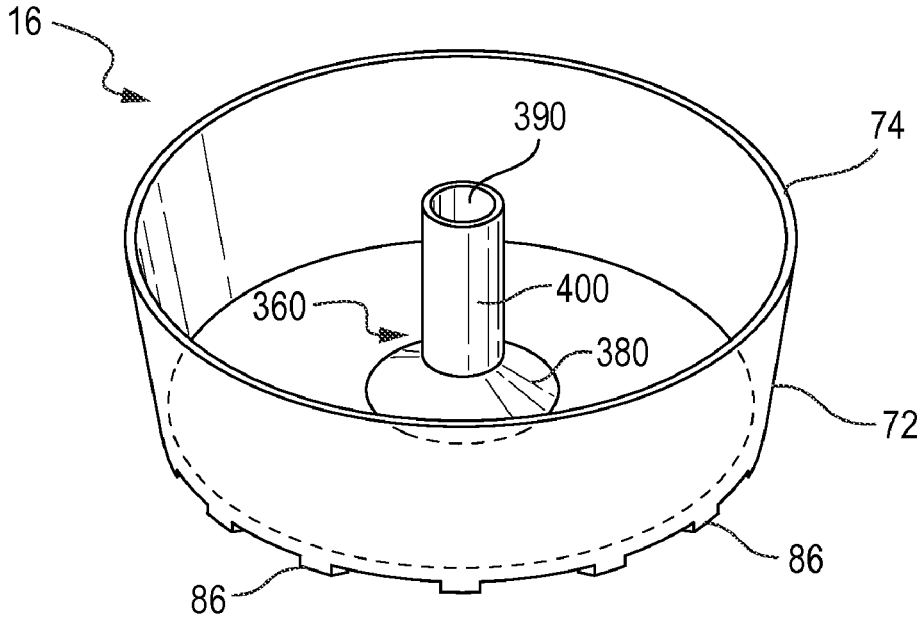
FIG. 12 shows a perspective view of a base bowl.

FIG. 12 provides a perspective view of a preferred base bowl 16. A base bowl 16 can be removably positioned at and supported by the bottom of the bucket 18 within the sleeve 12. The bowl 16 includes a large top opening that captures material that has been filtered from above.

It is preferred that the bowl 16 is configured to have sides 72 that do not come into contact with the inner walls of the sleeve 12 in a natural resting position. It is further preferred that the gap between the inner walls of the sleeve 12 and the side walls 72 of the bowl 16 is larger than the gaps between the periphery of the sieves 6, 8*a*, 8*b* and the inner faces of the bucket 18. As an example, the sides of the bowl 16 can be tapered at a higher degree than the angles of the walls of the sleeve 12 or bucket 18. A larger gap between the bowl 16 and the sleeve 12 is advantageous in preventing or alleviating clogging or backup, especially for wet sifting methods. Examples of suitable gaps between the sides 72 of the bowl 16 and the sleeve 12 include those larger than ⅛ inch. According to other embodiments, the gaps between the sides 72 of the bowl 16 and the sleeve 12 are about ⅛ inch.

Figure 13:
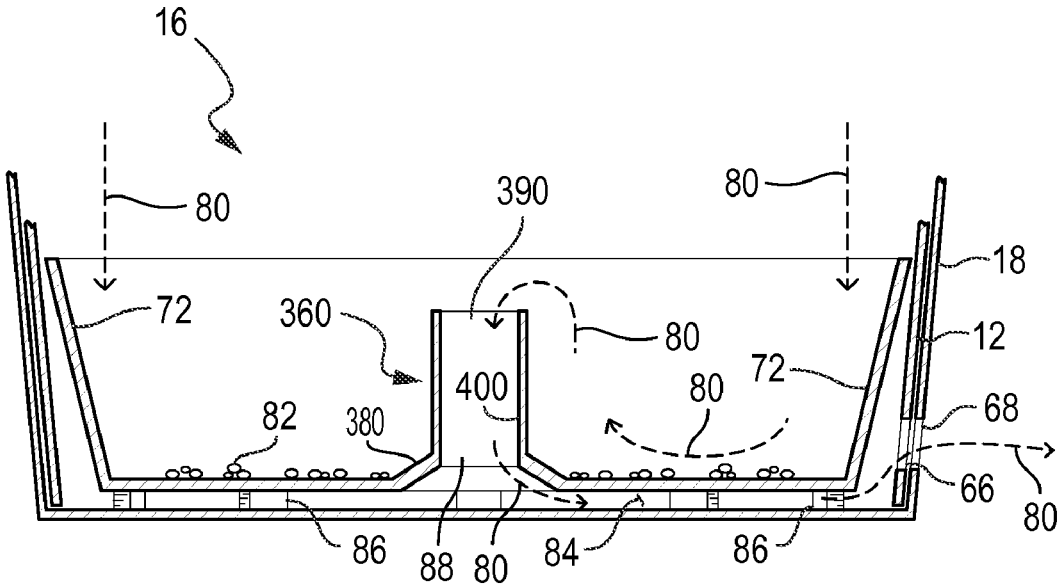
FIG. 13 shows a side view of a base bowl.

Means for allowing removal and positioning of the bowl 16 can also be implemented. As shown in FIGS. 12 and 13, preferably a protrusion 360 extends upwards from the bottom to function as a handle for a user to grip when desiring to remove or position the bowl 16. More specifically it is preferred that the protrusion 360 is positioned centrally on the bottom of the bowl 16. Although any suitable vertical extension can be used, one advantageous design includes a vertical stem 400 that extends upwards from a base skirt 380 that flanges outward at a downward angle. The protrusion 360 should not extend too high such as to interfere with the underside of the sluice section 14 or a lower sieve 8*b* positioned above it. According to preferred embodiments, and as shown in FIG. 13, the protrusion 360 is hollow to allow for water 80 to enter while heavier materials 82 such as gold will sink to the bottom if the bowl 16. Water 80 can flow down from the sluice section 14 or the lowest sieve 8*b* into the top opening of the bowl 16, then into the top opening 390 of the vertical stem 400 and downward through the base skirt 380 and out a bottom hole 88 to a space 84 between the underside of the bowl 16 and the bottom of the bucket 18. A plug or cover for the top opening of the protrusion 360 can be used for dry filtering embodiments, where no water 80 is added.

Alternatively, no protrusion can be present in the bowl and a user can rely on a hole in the bottom of bowl for removal of water and for gripping for positioning and removal of the bowl. A plug or cover can also be used for this hole. According to further non-preferred embodiments, the bowl can include an inner rim downwardly angled from the top, like the top sieve 6 shown in FIG. 5 utilizes.

Figure 14:
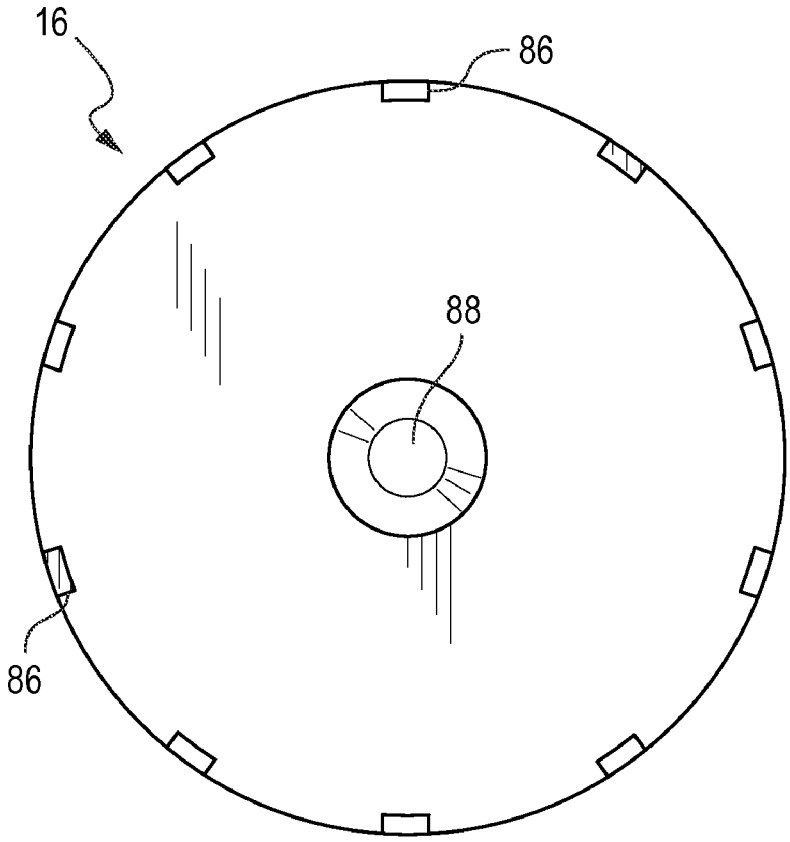
FIG. 14 shows an underside view of a base bowl.

FIG. 14 shows a preferred underside of the bowl 16. A central opening 88 serves as a hub that allows water 80 to flow away from the central opening 88 to the sleeve and bucket exit holes 66 and 68. Preferably, the underside of the bowl 16 includes a plurality of support stands 86 that can be configured to have sufficient load bearing strength to support the base bowl 16 filled with water and elevate the base bowl 16 above the bottom surface of the bucket 18 such as to define a sufficient gap 84 between these surfaces to allow for water 80 flow and to prevent back up. Additionally, the stands 86 should be able to support a sluice section 14 stacked on top of the bowl 16. Preferably the stands 86 are intermittently spaced on the underside, such as around the perimeter 72, and allow for water 80 to flow along the inside of the walls 72 without significant obstruction. Likewise the exit hole 88 and the protrusion 360 should be configured such as to allow water 80 to flow out of the bowl 16 at a faster rate than it enters, to prevent back up in the sluice section 14. As the water entering the sluice section 14 is determined by the funnel 10, it is preferred that the top opening in the stem 400 is larger than the bottom opening in the funnel 10. The base bowl 16 and its parts can be made of any suitable material, but is preferably made of high impact plastic.

According to further embodiments, multiple support ribs can radiate away from the exit hole 88 like spokes from a hub to define substantially triangular channels that direct water 80 away from the central opening 88 to the sleeve and bucket exit holes 66 and 68. The ribs should be configured to have sufficient load bearing strength as discussed above with the stands 86. Preferably the ribs don't extend to the side walls 72 of the bowl to allow for water 80 to flow more freely between the walls 72 of the bowl 16 and sleeve 12.

For embodiments, directed to dry sifting, without the use of water, the assembly depicted in FIG. 2 and described above can readily be used. For certain embodiments that provide a user the option to engage in wet filtering with water, the kits can also include a funnel 10 and a sluice section 14 as shown in FIG. 1. It is also readily contemplated that the kit 2 shown in FIG. 2 can also be used with water in addition to dry separation. More particularly, a user may not desire to use a funnel 10 or a sluice section 14 if they only wanted to separate the objects from the earth material by size instead of weight, and thus may choose to forego the use of these parts when using water. Objects that are typically separated by size non-exclusively include fossils, artifacts, and rocks, for example. Conversely, the configuration of FIG. 1 that utilizes a sluice section 14 and funnel 10 would not be used for dry separation techniques, without the use of water. This configuration is advantageous for separating materials by size and by weight, such as gold, for example.

Figure 8:
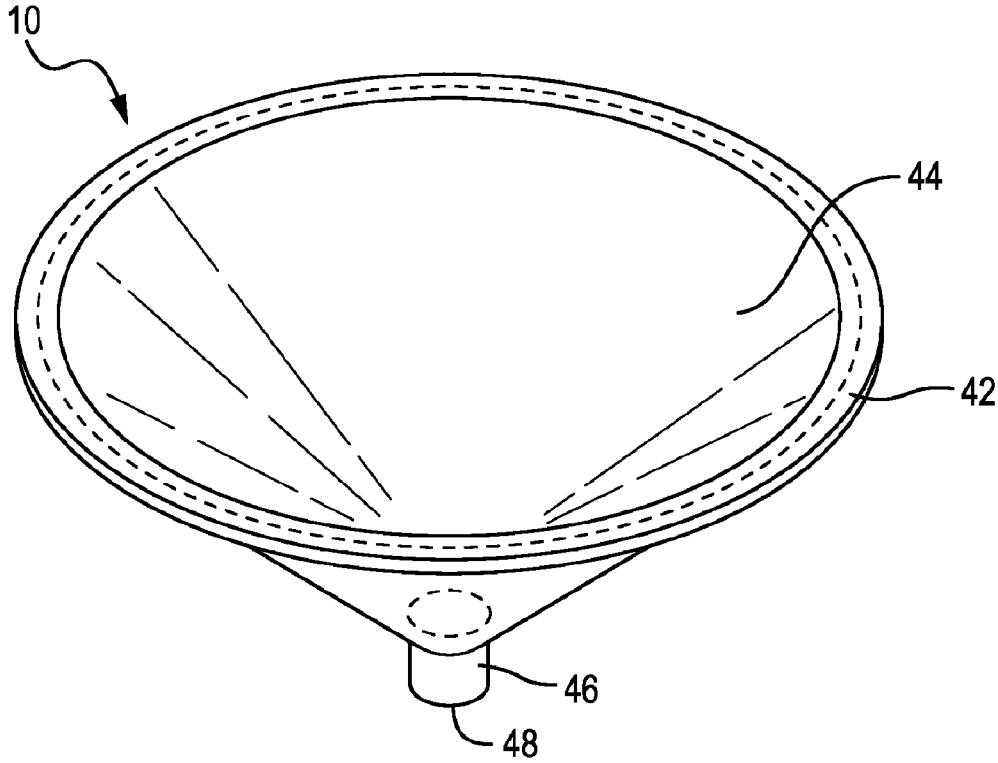
FIG. 8 is a perspective view of a funnel.

As shown in FIG. 8, a funnel 10 generally has a wide top opening 44 that tapers downward to form a stem 46 having a bottom opening 48 that is smaller than the top opening 44. The smaller bottom exit 48 allows for a controlled, steady, directed stream of liquid and material to descend from the top opening 44 into the sluice section 14 below. As a way to remove the funnel 10 from the bucket 18, a user can place a finger into the stem 46 and out the opening 48, hook their finger around the rim of the opening 48 and pull upwards. Preferably the funnel 10 can include a peripheral lip 42 defining the wide top opening 44. As shown in FIG. 1, the top rim 64 of the sleeve 12 can abut against the underside of the funnel's lip 42 instead of the lowest sieve 8*b* when a funnel 10 is used with the kit 2. This particular configuration allows the funnel 10 to hover above the sluice section 14 as opposed to abutting against it. The sleeve 12 and the funnel 10 are preferably configured to align the funnel 10 in a position above the sluice section 14 such that water exits downward out of the bottom hole 48 above the vertical protrusion 52 of the sluice 50. It is additionally preferred that the funnel 10 is close to but does not contact the inner sides of the bucket 18 when the kit 2 is its natural state, not being moved.

The funnel 10 has sides sloped to a degree that causes any material passing through the sieves 6, 8*a*, and 8*b* above to flow freely in water out of the funnel's bottom opening 48 by gravitational phenomena. The bottom opening 48 is configured diameter such that a calibrated amount of water will flow into the sluice section 14 below and prevent too much water from entering the sluice section 14. Thus the funnel 10 and the sieves 6, 8*a*, and 8*b* above act together to create a larger water holding reservoir thereby allowing for proper function of the sluice section 14.

As shown in FIG. 1, the sluice section 14 is used in conjunction with and positioned below the funnel 10 within the bucket 18. The sluice section 14 can be supported vertically by the upper rim 74 of the base bowl 16 which can be configured to abut against the underside of the sluice section 14. As mentioned above, it is preferred that the sluice section 14 does not make contact with the funnel 10 positioned above. According to more specific embodiments, the outer perimeter of the sluice section 54 is not in contact with the inner walls of the sleeve 12 when the kit 2 is in its natural position, not being moved.

Figure 9:
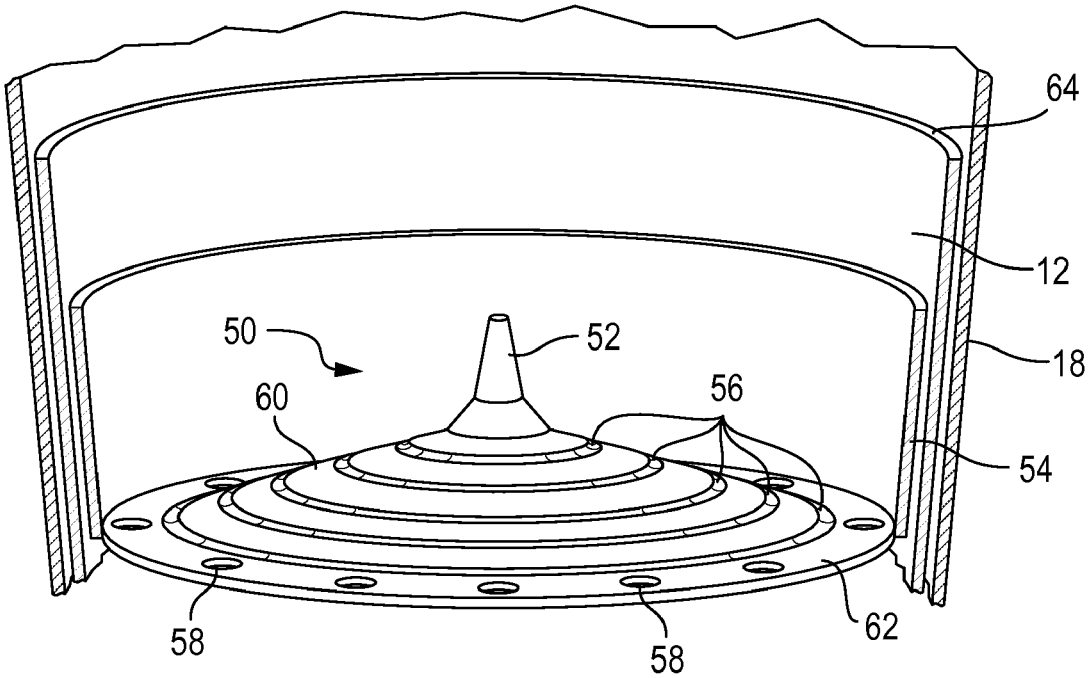
FIG. 9 is a side view of the sluice section.
Figure 10:
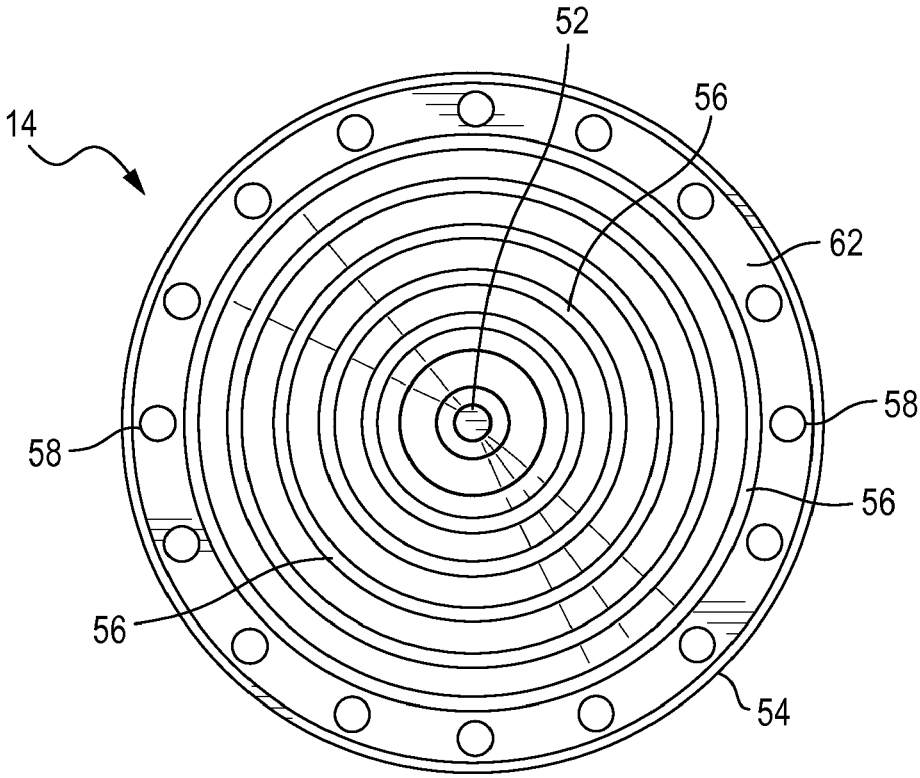
FIG. 10 is a top view of the sluice section.

As shown in FIGS. 9 and 10, the outer perimeter 54 of the sluice section 14 surrounds a centrally positioned radial sluice 50 that can utilize water and gravitational force to classify materials having different weights. Preferably, the radial sluice 50 generally has a cone shaped body 60 etched with multiple concentric grooves 56 with progressively larger diameters from the top of the sluice 50 to the bottom. In addition to having larger diameters, the concentric grooves 56 preferably get narrower and shallower as they progress downward from the top of the sluice 50 to the bottom. This is advantageous as water flow will slow as it is spreads across the wider plane of the sluice 50. The sleeve 12, funnel 10 and sluice section 14 are configured such that water streams out of the funnel opening 48 at a steady rate, and the water, along with its accompanying solids, travels down the sluice 50 such that heavier materials (such as gold) in the water fall and become trapped within the grooves 56 while water and lighter materials travel over the grooves 56 down the body 60 of the sluice 50. The base of the sluice 50 is preferably defined by a lower lip 62 having a plurality of drainage holes 58 positioned around it. The drainage holes 58 can be configured to allow water and lighter materials not trapped within the grooves 56 to drain into the base bowl 16 below. Having multiples drainage holes 58 is advantageous as it helps ensure that water is exiting the sluice section 14 faster than it is coming in through the bottom opening 48 in the funnel 10.

It is preferred that the apex of the radial sluice 50 includes a vertical protrusion 52 having a vertical stem extending upward from a base skirt that flanges downward towards the grooves 56. This is advantageous in dispersing water flow evening, or substantially so, across the sluice 50 plane. Additionally the vertical protrusion 52 is advantageous as a handle for a user to grip in order to remove the sluice section 14 or to set it within the bucket 18. The sluice section can be made of any suitable material such as high impact plastic, for example.

Two main filtering techniques can be utilized with the kits 2 herein for classifying objects from earth material: (1) dry and (2) wet. According to dry sifting methods it is preferred that the kit either doesn't include the funnel 10 and the sluice section 14 or that it does and the user simply removes them from the bucket 18. This particular configuration is shown in FIG. 2. In contrast, methods of wet separation can either utilize the funnel 10 and the sluice section 14 as shown in FIG. 1 or not, depending on whether the user also wants to separate objects from the water by weight using a sluice 50, or merely by size through the sieves 6, 8*a*, and 8*b*. Accordingly at least two main types of kits 2 can be sold, a kit having a removable funnel 10 and sluice section 14 (FIG. 1) or kits that do not have a funnel or sluice section (FIG. 2).

For dry sifting techniques, the kit 2 can be configured as shown in FIG. 2. A user can remove the lid 4 from the top of the bucket 18 and pour the earth material into the top classifying sieve 6. The user can then hold and agitate the bucket 18 by swirling or shaking it back and forth. The movement of the bucket 18 combined with gravitational phenomena will separate material by size through the classifying sieves 6, 8*a*, and 8*b*. More specifically, larger objects will remain on the top sieve 6 which has the largest sized mesh, while medium sized objects will remain on the first lower sieve 8*a* which has a finer mesh screen then the top sieve 6, while even smaller objects will remain on the second lower sieve 8*b* which has the finest mesh.

Matter that is finer than the mesh screen of the bottom sieve 8*b* will fall downward into the base bowl 16. After agitation, a user can remove the top sieve 6, such as by grabbing the inner rim 32, and examining the remaining material on the screen 26 for fossils, artifacts, rocks, gold, or gems. Likewise the remaining sieves 8*a* and 8*b* can also be removed, such as by grabbing onto their protrusions 36 and pulling upward. After removal, these sieves 8*a* and 8*b* can likewise be examined for desired objects that may have been mixed with the earth material. After examination, the matter from the classifying sieves 6, 8*a*, and 8*b* can be emptied, to be retained or discarded, and the sieves 6, 8*a*, and 8*b* can be returned to the inside of the bucket 18, in order from lowest to highest, so a user can separate and examine a new sample of earth material. As the difference in diameter or mesh size between the sieves 6, 8*a*, and 8*b* may be difficult to distinguish quickly, the sieves 6, 8*a*, and 8*b* can be identified such as by numbering and/or colors in order to facilitate a user in placing the sieves 6, 8*a*, and 8*b* back into their designated positions within the bucket 18. In addition to removing the sieves 6, 8*a*, and 8*b*, a user can also remove the base bowl 16 and empty it of material.

For wet sifting techniques, the bucket 18 can also be configured as shown in FIG. 2, however, instead of or in addition to agitation the bucket 18 with movement, a user can pour water into the top opening of the bucket 18 to filter objects from the classifying sieves 6, 8*a*, and 8*b*. The force of the water will separate material by size through the classifying sieves 6, 8*a*, and 8*b*. Water can be supplied to the top opening of the bucket 18 through any suitable method. More specifically it is preferred that the kit 2 is configured such that water will exit out of the bucket 18 through the hole 68 faster than it enters. As one option, a user can simply utilize a secondary bucket to hold and pour water into the kit 2, such as a bucket of equal size to the bucket 18 used in the kits 2 so it easy to stack the two buckets together.

Additional wet filtering techniques can utilize a funnel 10 and a sluice section 14 as shown in FIG. 1, such as when a user desires to separate materials from earth material based on size and also on weight. This particular configuration is highly advantageous in classifying gold, for example. In addition to examining the classifying sieves 6, 8*a*, and 8*b* a user can remove the sluice section 14 and examine the grooves 56 in the sluice 50 for desired objects. Furthermore, the user can remove the base bowl 16 and examine the material sunken at the bottom. For even further examination of the bowl 16 materials, a user can simply dump the contents from the bottom of the bowl 16 into a gold pan such as the lid 4. If there is insufficient water from the bowl 16, more water can be added, and the contents can be swirled and separated using suitable gold panning techniques to find desired objects, such as gold particles.

All references listed herein are expressly incorporated by reference in their entireties. The invention may be embodied in other specific forms besides and beyond those described herein. The foregoing embodiments are therefore to be considered in all respects illustrative rather than limiting, and the scope of the invention is defined and limited only by the appended claims and their equivalents, rather than by the foregoing description.

The invention claimed is:

1. A kit for classifying objects from earth material comprising:

a bucket having a top aperture opening to a lower main cavity defined by a periphery, and a bottom surface;

a first classifying sieve having a mesh screen surrounded by a perimeter and configured to be removably positioned inside the main cavity near the top aperture of the bucket; and a support sleeve configured to removably fit within the bucket near the bucket periphery such that it is vertically supported by the bottom surface of the bucket and includes a top surface that provides vertical support for the first classifying sieve.

2. The kit of claim 1, further comprising a plurality of vertically stacked classifying sieves, including said first classifying sieve and a bottom classifying sieve, configured to be removably positioned inside the main cavity and vertically supported by the support sleeve, wherein the plurality of classifying sieves have progressively finer mesh screens as positioned from top to bottom.

3. The kit of claim 2, wherein at least one of said plurality of classifying sieves includes a protrusion extending upwards from the center of the mesh screen.

4. The kit of claim 2, further comprising a funnel and a radial sluice configured to be removably positioned inside of the main cavity, wherein the funnel is configured to be positioned below the bottom classifying sieve such that it is vertically supported by the support sleeve and provides vertical support to said plurality of classifying sieves, wherein the funnel includes a large top opening that tapers to a small exit hole at the bottom; and wherein the radial sluice is configured to be positioned below the funnel, and comprises a central apex positioned below the funnel exit hole and a body comprising multiple concentric grooves with progressively larger diameters as positioned from the top of the sluice to the bottom, such that when water, along with its accompanying solids, streams from the exit hole of the funnel to the apex of the sluice, it travels down the sluice such that heavier materials in the water fall and become trapped within the concentric grooves while water and lighter materials travel over the grooves down the body of the sluice.

5. The kit of claim 3, wherein the concentric grooves are progressively narrower and shallower as positioned from the top of the sluice to the bottom.

6. The kit of claim of claim 4, wherein the sluice includes bottom drainage holes that are configured to allow water to exit the sluice at a faster rate than entering from the funnel.

7. The kit of claim 6, further comprising a bowl positioned on the bottom of the bucket and within the support sleeve, wherein the bowl vertically supports the radial sluice and the drainage holes of the sluice are configured to drain into said bowl.

8. The kit of claim 7, wherein the bowl includes means for allowing water to exit into the support sleeve.

9. The kit of claim 8, wherein said means include a central hollow protrusion that extends upwards from the bottom of the bowl and comprises a top opening and a bottom exit that allows water flow into the support sleeve.

10. The kit of claim 9, wherein the underside of the bowl includes a plurality of support stands configured to elevate the bowl above the bottom surface of the bucket such as to define a sufficient gap between these surfaces to allow for water flow.

11. The kit of claim 8, wherein said support sleeve and bucket individually comprise drainage holes that are configured to align with each other to allow water to exit the bucket.

12. The kit of claim 1, further comprising a lid having a top opening defined by an outwardly projecting peripheral having an underside circumferential groove configured to releasably attach onto the top aperture of the bucket and sides that taper downward to a recessed bottom that is configured to be positioned within the main cavity of the bucket, above the top classifying sieve, when the lid is attached to the top aperture of the bucket.

13. A kit for classifying objects from earth material comprising:

a substantially cylindrical bucket having a top aperture opening to a lower main cavity defined by a periphery that slightly tapers downward to a bottom surface;

a first classifying sieve, having a substantially cylindrical shape, and having a mesh screen surrounded by a perimeter and having means to be removably positioned inside the main cavity of the bucket;

a plurality of vertically arranged classifying sieves, including said first classifying sieve and a bottom classifying sieve, having means to be removably positioned inside the main cavity, wherein the plurality of classifying sieves have progressively finer mesh screens from top to bottom; and further comprising a funnel and a radial sluice configured to be removably positioned inside of the main cavity, wherein the funnel is configured to be positioned below the bottom classifying sieve and wherein the funnel includes a large top opening that tapers to a small exit hole at the bottom; and wherein the radial sluice is configured to be positioned below the funnel, and comprises a central apex positioned below the funnel exit hole and a body comprising multiple concentric grooves with progressively larger diameters as positioned from the top of the sluice to the bottom, such that when water, along with its accompanying solids, streams from the exit hole of the funnel to the apex of the sluice, it travels down the sluice such that heavier materials in the water fall and become trapped within the concentric grooves while water and lighter materials travel over the grooves down the body of the sluice.

14. The kit of claim of claim 13, wherein the sluice includes bottom drainage holes that are configured to allow water to exit the sluice at a faster rate than entering from the funnel.

15. The kit of claim 14, further comprising a bowl positioned on the bottom of the bucket, wherein the bowl vertically supports the radial sluice and the drainage holes of the sluice are configured to drain into said bowl.

16. The kit of claim 15, wherein the bowl includes means for allowing water to exit out of it into the bucket, and the bucket includes means for allowing water to exit.

17. The kit of claim 16, wherein said means for allowing water to exit from the bowl include a central hollow protrusion that extends upwards from the bottom of the bowl and comprises a top opening and a bottom exit that allows water to flow into the underside of the bowl, and wherein the underside of the bowl includes a plurality of support stands configured to elevate the bowl above the bottom surface of the bucket such as to define a sufficient gap between these surfaces to allow for water flow.

* * * * *